United States Patent [19]

Radwanski et al.

[11] Patent Number: 4,931,355

[45] Date of Patent: Jun. 5, 1990

[54] NONWOVEN FIBROUS HYDRAULICALLY ENTANGLED NON-ELASTIC COFORM MATERIAL AND METHOD OF FORMATION THEREOF

[76] Inventors: Fred R. Radwanski, 4310 Mary Ct., Norcross, Ga. 30092; Lloyd E. Trimble, Rte. 2, Box 33A, Dustin, Okla. 74839; Leon E. Chambers, Jr., 245 Mill Creek Pl., Roswell, Ga. 30076; Linda A. Connor, 76 Spalding Trail, Atlanta, Ga. 30328

[21] Appl. No.: 170,208

[22] Filed: Mar. 18, 1988

[51] Int. Cl.[5] ..... B32B 5/16

[52] U.S. Cl. ..... 428/283; 28/104; 428/253; 428/255; 428/284; 428/288; 428/297; 428/299; 428/903; 428/913

[58] Field of Search ..... 428/288, 171, 172, 297, 428/299, 903, 913, 300, 284, 283, 326, 253, 255; 28/104

[56] References Cited

U.S. PATENT DOCUMENTS

| | | | |
|---|---|---|---|
| Re. 31,601 | 6/1984 | Ikeda et al. | 428/93 |
| 3,485,706 | 12/1969 | Evans | 161/72 |
| 3,486,168 | 12/1969 | Evans et al. | 161/169 |
| 3,494,821 | 2/1970 | Evans | 161/169 |
| 3,560,326 | 2/1971 | Bunting et al. | 161/169 |
| 3,563,241 | 2/1971 | Evans | 128/284 |
| 3,620,903 | 11/1971 | Bunting et al. | 161/169 |
| 3,741,724 | 6/1973 | Harmon | 8/115.5 |
| 4,100,324 | 7/1978 | Anderson et al. | 428/288 |
| 4,118,531 | 10/1978 | Hauser | 428/224 |
| 4,190,695 | 2/1980 | Niederhauser | 428/234 |
| 4,251,581 | 2/1981 | Mimura et al. | 428/95 |
| 4,302,495 | 11/1981 | Marra | 428/110 |
| 4,426,420 | 1/1984 | Likhyani | 428/224 |
| 4,426,421 | 1/1984 | Nakamae et al. | 428/234 |
| 4,442,161 | 4/1984 | Kirayoglu et al. | 428/219 |
| 4,604,313 | 8/1986 | McFarland et al. | 428/300 |
| 4,612,237 | 9/1986 | Frankenberg | 428/219 |
| 4,623,576 | 11/1986 | Lloyd et al. | 428/288 |
| 4,681,801 | 7/1987 | Eian et al. | 428/903 |
| 4,755,178 | 7/1988 | Insley et al. | 428/288 |
| 4,775,579 | 10/1988 | Hagy et al. | 428/284 |
| 4,808,467 | 2/1989 | Suskind et al. | 428/284 |
| 4,818,594 | 4/1989 | Albien et al. | 428/224 |

FOREIGN PATENT DOCUMENTS

| | | |
|---|---|---|
| 841938 | 5/1970 | Canada . |
| 108621 | 5/1984 | European Pat. Off. . |
| 128667 | 5/1984 | European Pat. Off. . |
| 1367944 | 9/1974 | United Kingdom . |

OTHER PUBLICATIONS

"Burlington Tries Polyester/Cotton Spunlace" Nonwovens World May–Jun. 1987, pp. 19 and 21.

"First Weaving, Then Knitting, Now Spunlaced Nonwovens" Nonwovens Industry, Jul. 1987, pp. 32, 34 and 35.

"Water Jet Entangled Nonwovens" John R. Starr, Insight 87 9–21–87, pp. 1–20.

"Progress with Sontana and Spunlaced Fabrics in Europe" Nonwovens Report Jan. 1978, pp. 7 and 8.

"Composite of Synthetic–Fiber Web and Papers" Research Disclosure No. 09196/78 Jun. 1978.

"The Perfojet Entanglement Process" Andre Vuillaume, Nonwovens World, Feb. 1987, pp. 81–84.

*Primary Examiner*—James J. Bell

[57] ABSTRACT

Nonwoven fibrous non-elastic webs, reinforced nonwoven fibrous non-elastic webs and methods of forming the same are disclosed. The nonwoven fibrous non-elastic webs are a hydraulically entangled coform or admixture of non-elastic meltblown fibers and fibrous material, with or without particulate material. The fibrous material (e.g., non-elastic fibrous material) can be at least one of pulp fibers, staple fibers, meltblown fibers and continuous filaments. The use of meltblown fibers facilitates the hydraulic entangling, resulting in a high degree of entanglement and enabling the more effective use of shorter fibrous material. The hydraulic entangling technique provides a nonwoven fibrous material having increased web strength and allows for better control of other product attributes, such as absorbency, wet strength, printability and abrasion resistance. The coform can be hydraulically entangled with a reinforcing material, e.g., a melt-spun nonwoven, a scrim, screen, net, etc.

26 Claims, 4 Drawing Sheets

NONWOVEN FIBROUS HYDRAULICALLY ENTANGLED NON-ELASTIC COFORM MATERIAL AND METHOD OF FORMATION THEREOF

BACKGROUND OF THE INVENTION

The present invention relates to nonwoven fibrous non-elastic material, and reinforced nonwoven fibrous material, wherein the nonwoven fibrous material is a hydraulically entangled coform (e.g., admixture) of non-elastic meltblown fibers and fibrous material (e.g., non-elastic fibrous material), with or without particulate material. The fibrous material can be at least one of pulp fibers, staple fibers, meltblown fibers and continuous filaments. Such material has applications for wipes, tissues and garments, among other uses.

Moreover, the present invention relates to methods of forming such nonwoven material and methods of forming reinforced nonwoven material by hydraulic entangling techniques.

It has been desired to provide a coform having increased web strength, low linting and high durability without a significant loss of the web's drape, bulk and cloth-like hand. Moreover, it has been desired to provide such coform materials as part of, e.g., a laminate, having various uses such as in protective clothing, wipes and as cover-stock for personal care absorbent products.

U.S. Pat. No. 4,100,324 to Anderson et al, the contents of which are incorporated herein by reference, discloses a nonwoven fabric-like composite material which consists essentially of an air-formed matrix of thermoplastic polymer microfibers having an average fiber diameter of less than about 10 microns, and a multiplicity of individualized wood pulp fibers disposed throughout the matrix of microfibers and engaging at least some of the microfibers to space the microfibers apart from each other. This patent discloses that the wood pulp fibers can be interconnected by and held captive within the matrix of microfibers by mechanical entanglement of the microfibers with the wood pulp fibers, the mechanical entanglement and interconnection of the microfibers and wood pulp fibers alone, without additional bonding, e.g., thermal, resin, etc., and thus forming a coherent integrated fibrous structure. However, the strength of the web can be improved by embossing the web either ultrasonically or at an elevated temperature so that the thermoplastic microfibers are flattened into a film-like structure in the embossed areas. Additional fibrous and/or particulate materials including synthetic fibers such as staple nylon fibers and natural fibers such as cotton, flax, jute and silk can be incorporated in the composite material. The material is formed by initially forming a primary air stream containing meltblown microfibers, forming a secondary air stream containing wood pulp fibers (or wood pulp fibers and/or other fibers, with or without particulate material), merging the primary and secondary streams under turbulent conditions to form an integrated air stream containing a thorough mixture of the microfibers and wood pulp fibers, and then directing the integrated air stream onto a forming surface to airform the fabric-like material.

U.S. Pat. No. 4,118,531 to Hauser relates to microfiber-based webs containing mixtures of microfibers and crimped bulking fibers. This patent discloses that crimped bulking fibers are introduced into a stream of blown microfibers. The mixed stream of microfibers and bulking fibers then continues to a collector where a web of randomly intermixed and intertangled fibers is formed.

U.S. Pat. No. 3,485,706 to Evans discloses a textile-like nonwoven fabric and a process and apparatus for its production, wherein the fabric has fibers randomly entangled with each other in a repeating pattern of localized entangled regions interconnected by fibers extending between adjacent entangled regions. The process disclosed in this patent involves supporting a layer of fibrous material on an apertured patterning member for treatment, jetting liquid supplied at pressures of at least 200 pounds per square inch psi) gage to form streams having over 23,000 energy flux in foot-poundals/inch$^2$ . second at the treatment distance, and traversing the supporting layer of fibrous material with the streams to entangle fibers in a pattern determined by the supporting member, using a sufficient amount of treatment to produce uniformly patterned fabric. The initial material is disclosed to consist of any web, mat, batt or the like of loose fibers disposed in random relationship with one another or in any degree of alignment.

U.S. Pat. No. Re. 31,601 to Ikeda et al discloses a fabric, useful as a substratum for artificial leather, which comprises a woven or knitted fabric constituent and a nonwoven fabric constituent. The nonwoven fabric constituent consists of numerous extremely fine individual fibers which have an average diameter of 0.1 to 6.0 microns and are randomly distributed and entangled with each other to form a body of nonwoven fabric. The nonwoven fabric constituent and the woven or knitted fabric constituent are superimposed and bonded together, to form a body of composite fabric, in such a manner that a portion of the extremely fine individual fibers and the nonwoven fabric constituent penetrate into the inside of the woven or knitted fabric constituent and are entangled with a portion of the fibers therein. The composite fabric is disclosed to be produced by superimposing the two fabric constituents on each other and jetting numerous fluid streams ejected under a pressure of from 15 to 100 kg/cm$^2$ toward the surface of the fibrous web constituent. This patent discloses that the extremely fine fibers can be produced by using any of the conventional fiber-producing methods, preferably a meltblown method.

U.S. Pat. No. 4,190,695 to Niederhauser discloses lightweight composite fabrics suitable for general purpose wearing apparel, produced by a hydraulic needling process from short staple fibers and a substrate of continuous filaments formed into an ordered cross-directional array, the individual continuous filaments being interpenetrated by the short staple fibers and locked in place by the high frequency of staple fiber reversals. The formed composite fabrics can retain the staple fibers during laundering, and have comparable cover and fabric aesthetics to woven materials of higher basis weight.

U.S. Pat. No. 4,426,421 to Nakamae et al discloses a multi-layer composite sheet useful as a substrate for artificial leather, comprising at least three fibrous layers, namely, a superficial layer consisting of spun-laid extremely fine fibers entangled with each other, thereby forming a body of a nonwoven fibrous layer; an intermediate layer consisting of synthetic staple fibers entangled with each other to form a body of nonwoven fibrous layer; and a base layer consisting of a woven or knitted fabric. The composite sheet is disclosed to be prepared by superimposing the layers together in the aforementioned order and, then, incorporating them together to form a body of composite sheet by means of a needle-punching or water-stream-ejecting under a high pressure. This patent discloses that the spun-laid extremely fine fibers can be produced by the meltblown method.

U.S. Pat. No. 4,442,161 to Kirayoglu et al discloses a spunlaced (hydraulically entangled) nonwoven fabric and a process for producing the fabric, wherein an assembly consisting essentially of wood pulp and synthetic organic fibers is treated, while on a supporting member, with fine columnar jets of water. This patent discloses it is preferred that the synthetic organic fibers be in the form of continuous filament nonwoven sheets and the wood pulp fibers be in the form of paper sheets.

Existing hydraulically entangled materials suffer from a number of problems. Such materials do not exhibit isotropic properties, are not durable (e.g., do not have good pill resistance) and do not have enough abrasion resistance. Therefore, it is desired to provide a nonwoven web material having high web strength and integrity, lower linting and high durability without a significant loss of the web's drape, bulk and cloth-like hand. Moreover, it is desired to provide a process for producing such a material which allows for control of other product attributes, such as absorbency, isotropic properties, wet strength, barrier properties, printability and abrasion resistance.

SUMMARY OF THE INVENTION

Accordingly, it is an object of the present invention to provide a hydraulically entangled nonwoven fibrous material (e.g., a nonwoven fibrous self-supporting material, such as a web) having a high web strength and integrity, low linting and high durability, and methods for forming such material.

It is a further object of the present invention to provide a reinforced nonwoven fibrous web material, wherein the web includes a reinforcing material, e.g., a melt-spun nonwoven, a scrim, screen, net, knit, woven material, etc., and methods of forming such reinforced nonwoven fibrous web material.

The present invention achieves each of the above objects by providing a composite nonwoven fibrous non-elastic web material formed by hydraulically entangling a coform comprising an admixture of non-elastic meltblown fibers and fibrous material, with or without particulate material. The fibrous material can be at least one of pulp fibers, staple fibers, meltblown fibers and continuous filaments. The use of meltblown fibers as part of the deposited admixture subjected to hydraulic entangling facilitates entangling. This results in a high degree of entanglement and allows the more effective use of shorter fibrous material. Meltblown fibers can be relatively inexpensive (more economical) and have high covering power (i.e., a large surface area), and thus increase economy. Moreover, the use of meltblown fibers can decrease the amount of energy needed to hydraulically entangle the coform as compared to entangling separate layers and producing an intimate blend.

The use of meltblown fibers provides an improved product in that the entangling and intertwining among the meltblown fibers and fibrous material (e.g., non-elastic fibrous material) is improved. Due to the relatively great length and relatively small thickness (denier) of the meltblown fibers, wrapping or intertwining of meltblown fibers around and within other fibrous material in the web is enhanced. Moreover, the meltblown fibers have a relatively high surface area, small diameters and are sufficient distances apart from one another to, e.g., allow cellulose, staple fiber and meltblown fibers to freely move and entangle within the fibrous web.

Moreover, use of meltblown fibers, as part of a coform web that is hydraulically entangled, have the added benefit that, prior to hydraulic entanglement, the web has some degree of entanglement and integrity. This can allow lower basis weight to be run and also can decrease the number of entangling treatments (energy) to achieve a given set of desired properties.

The use of hydraulic entangling techniques, to mechanically entangle (e.g., mechanically bond) the fibrous material, rather than using other bonding techniques, including other mechanical entangling techniques such as needle punching, provides a composite nonwoven fibrous web material having increased web strength and integrity, and allows for better control of other product attributes, such as absorbency, wet strength, hand and drape, printability, abrasion resistance, barrier properties, patterning, tactile feeling, visual aesthetics, controlled bulk, etc.

Moreover, by hydraulically entangling a coform of non-elastic meltblown fibers and fibrous material, together with a reinforcing material, the strength and integrity of the coform can be dramatically improved without serious reduction in the coform's drape and cloth-like hand.

In addition, by further adding a layer (web) of meltblown fibers to the coform web, and then hydraulically entangling such meltblown fiber layer/coform web, barrier properties of the formed structure (e.g., barrier to passage of liquids and particulate material) are enhanced while breathability is retained.

Hydraulically entangled coforms of the present invention can exhibit no measured loss in basis weight after being machine washed and can be used in durable applications. In many cases, fiber pilling does not occur because of the meltblown fibers within the coforms.

DETAILED DESCRIPTION OF THE INVENTION

Figure 1:
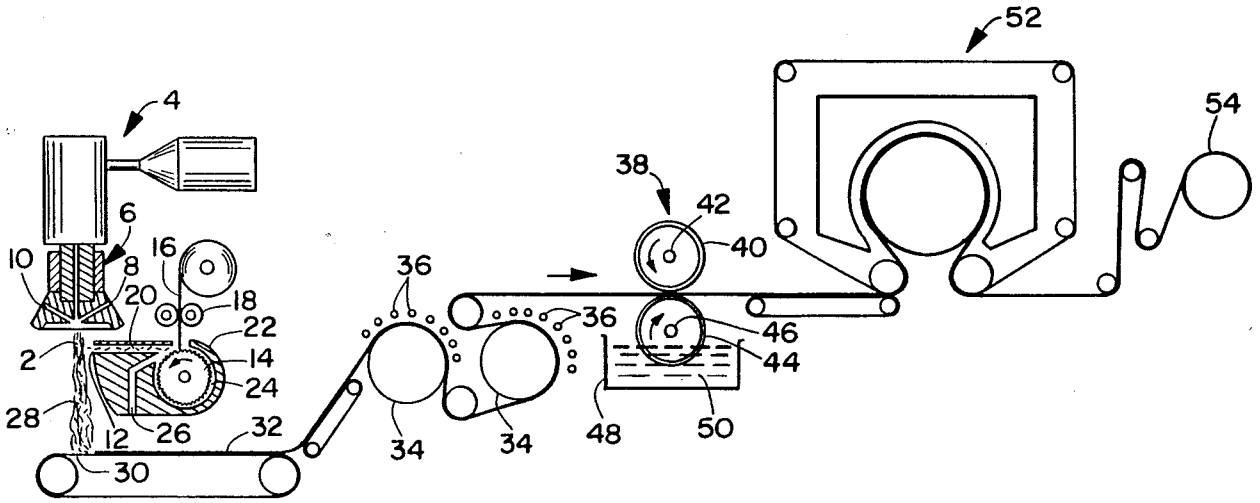
FIG. 1 is a schematic view of one example of an apparatus for forming a nonwoven hydraulically entangled coform material of the present invention.

While the invention will be described in connection with the specific and preferred embodiments, it will be understood that it is not intended to limit the invention to those embodiments. On the contrary, it is intended to cover all alterations, modifications and equivalents as may be included within the spirit and scope of the invention as defined by the appended claims.

The present invention contemplates a nonwoven fibrous web of hydraulically entangled coform material, and a method of forming the same, which involves the processing of a coform or admixture of non-elastic meltblown fibers and fibrous material (e.g., non-elastic fibrous material), with or without particulate material. The fibrous material can be at least one of pulp fibers, staple fibers, meltblown fibers and continuous filaments. The admixture is hydraulically entangled, that is, a plurality of high pressure, i.e., 100 psi (gauge) or greater, e.g., 100–3000 psi, liquid columnar streams are jetted toward a surface of the admixture, thereby mechanically entangling and intertwining the non-elastic meltblown fibers and the fibrous material, e.g., pulp fibers and/or staple fibers and/or meltblown fibers and/or continuous filaments, with or without particulates.

By a coform of non-elastic meltblown fibers and fibrous material, we mean a codeposited admixture of non-elastic meltblown fibers and fibrous material, with or without particulate materials. Desirably, the fibrous material, with or without particulates, is intermingled with the meltblown fibers just after extruding the material of the meltblown fibers through the meltblowing die, e.g., as discussed in U.S. Pat. No. 4,100,324. The fibrous material may include pulp fibers, staple fibers and/or continuous filaments. Such a coform may contain about 1 to 99% meltblown fibers by weight. By codepositing the meltblown fibers and at least one of staple fibers, pulp fibers and continuous filaments, with or without particulates, in the foregoing manner, a substantially homogeneous admixture is deposited to be subjected to the hydraulic entanglement. In addition, controlled placement of fibers within the web can also be obtained.

The fibrous material may also be meltblown fibers. Desirably, streams of different meltblown fibers are intermingled just after their formation, e.g., by extrusion, of the meltblown fibers through the meltblowing die or dies. Such a coform may be an admixture of microfibers, macrofibers or both microfibers and macrofibers. In any event, the coform preferably contains sufficient free or mobile fibers and sufficient less mobile fibers to provide the desired degree of entangling and intertwining, i.e., sufficient fibers to wrap around or intertwine and sufficient fibers to be wrapped around or intertwined.

It is not necessary that the coform web (e.g., the meltblown fibers) be totally unbonded when passed into the hydraulic entangling step. However, the main criterion is that, during the hydraulic entangling, there are sufficient free fibers (the fibers are sufficiently mobile) to provide the desired degree of entangling. Thus, if the meltblown fibers have not been agglomerated too much in the meltblowing process, such sufficient mobility can possibly be provided by the force of the jets during the hydraulic entangling. The degree of agglomeration is affected by process parameters, e.g., extruding temperature, attenuation air temperature, quench air or water temperature, forming distance, etc. Alternatively, the coform web can be, e.g., mechanically stretched and worked (manipulated), e.g., by using grooved nips or protuberances, prior to the hydraulic entangling to sufficiently unbond the fibers.

FIG. 1 schematically shows an apparatus for producing the nonwoven hydraulically entangled coform material of the present invention.

A primary gas stream 2 of non-elastic meltblown fibers is formed by known meltblowing techniques on conventional meltblowing apparatus generally designated by reference numeral 4, e.g., as discussed in U.S. Pat. Nos. 3,849,241 and 3,978,185 to Buntin et al and U.S. Pat. No. 4,048,364 to Harding et al, the contents of each of which are incorporated herein by reference. Basically, the method of formation involves extruding a molten polymeric material through a die head generally designated by the reference numeral 6 into fine streams and attenuating the streams by converging flows of high velocity, heated fluid (usually air) supplied from nozzles 8 and 10 to break the polymer streams into fibers of relatively small diameter. The die head preferably includes at least one straight row of extrusion apertures. The fibers can be microfibers or macrofibers depending on the degree of attenuation. Microfibers are subject to a relatively greater attenuation and have a diameter of up to about 20 microns, but are generally approximately 2 to 12 microns in diameter. Macrofibers generally have a larger diameter, i.e., greater than about 20 microns, e.g., 20–100 microns, usually about 20–50 microns. Generally, any non-elastic thermoformable polymeric material can be used for forming the meltblown fibers in the present invention, such as those disclosed in the aforementioned Buntin et al patents. However, polyolefins, in particular polyethylene and polypropylene, polyesters, in particular polyethylene terephthalate and polybutylene terephthalate, polyvinyl chloride and acrylates are some that are preferred. Copolymers of the foregoing materials may also be used.

The primary gas stream 2 is merged with a secondary gas stream 12 containing fibrous material, e.g., at least one of pulp fibers, staple fibers, meltblown fibers and continuous filaments, with or without particulates. Any pulp (wood cellulose) and/or staple fibers and/or meltblown fibers and/or continuous filaments, with or without particulates, may be used in the present invention. However, sufficiently long and flexible fibers are more useful for the present invention since they are more useful for entangling and intertwining. Southern pine is an example of a pulp fiber which is sufficiently long and flexible for entanglement. Other pulp fibers include red cedar, hemlock and black spruce. For example, a type Croften ECH kraft wood pulp (70% Western red cedar/30% hemlock) can be used. Moreover, a bleached Northern softwood kraft pulp known as Terrace Bay Long Lac-19, having an average length of 2.6 mm is also advantageous. A particularly preferred pulp material is IPSS (International Paper Super Soft). Such pulp is preferred because it is an easily fiberizable pulp material. However, the type and size of pulp fibers are not particularly limited due to the unique advantages gained by using high surface area meltblown fibers in the present invention. For example, short fibers such as eucalyptus, other such hardwoods and highly refined fibers, e.g., wood fibers and second-cut cotton, can be used since the meltblown fibers are sufficiently. small and encase and trap smaller fibers. Moreover, the use of meltblown fibers provide the advantage that material having properties associated with the use of small denier fibers (e.g., 1.35 denier or less) can be achieved using larger denier fibers. Vegetable fibers such as abaca, flax and milkweed can also be used.

Staple fiber materials (both natural and synthetic) include rayon, polyethylene terephthalate, cotton (e.g., cotton linters), wool, nylon and polypropylene.

Continuous filaments include filaments, e.g., 20μ or larger, such as spunbond, e.g., spunbond polyolefins (polypropylene or polyethylene), bicomponent filaments, shaped filaments, nylons or rayons and yarns.

The fibrous material can also include minerals such as fiberglass and ceramics. Also, inorganic fibrous material such as carbon, tungsten, graphite, boron nitrate, etc., can be used.

The secondary gas stream can contain meltblown fibers which may be microfibers and/or macrofibers. The meltblown fibers are, generally, any non-elastic thermoformable polymeric material noted previously.

The secondary gas stream 12 of pulp or staple fibers can be produced by a conventional picker roll 14 having picking teeth for divellicating pulp sheets 16 into individual fibers. In FIG. 1, the pulp sheets 16 are fed radially, i.e., along a picker roll radius, to the picker roll 14 by means of rolls 18. As the teeth on the picker roll 14 divellicate the pulp sheets 16 into individual fibers, the resulting separated fibers are conveyed downwardly toward the primary air stream 2 through a forming nozzle or duct 20. A housing 22 encloses the picker roll 14 and provides passage 24 between the housing 22 and the picker roll surface. Process air is supplied by conventional means, e.g., a blower, to the picker roll 14 in the passage 24 via duct 26 in sufficient quantity to serve as a medium for conveying fibers through the duct 26 at a velocity approaching that of the picker teeth.

Staple fibers can be carded and also readily delivered as a web to the picker or lickerin roll 14 and thus delivered randomly in the formed web. This allows use of high line speeds and provides a web having isotropic strength properties.

Continuous filaments can, e.g., be either extruded through another nozzle or fed as yarns supplied by educting with a high efficiency Venturi duct and also delivered as a secondary gas stream.

A secondary gas stream including meltblown fibers can be formed by a second meltblowing apparatus of the type previously described. The meltblown fibers in the secondary gas stream may be of different sizes or different materials than the fibers in the primary gas stream. The meltblown fibers may be in a single stream or two or more streams.

The primary and secondary streams 2 and 12 are merging with each other, with the velocity of the secondary stream 12 preferably being lower than that of the primary stream 2 so that the integrated stream 28 flows in the same direction as primary stream 2. The integrated stream is collected on belt 30 to form coform 32. With reference to forming coform 32, attention is directed to the techniques described in U.S. Pat. No. 4,100,324.

The hydraulic entangling technique involves treatment of the coform 32, while supported on an apertured support 34, with streams of liquid from jet devices 36. The support 34 can be any porous web supporting media, such as rolls, mesh screens, forming wires or apertured plates. The support 34 can also have a pattern so as to form a nonwoven material with such pattern. The apparatus for hydraulic entanglement can be conventional apparatus, such as described in U.S. Pat. No. 3,485,706 to Evans or as shown in FIG. 1 and described by Honeycomb Systems, Inc., Biddeford, Me., in the article entitled "Rotary Hydraulic Entanglement of Nonwovens" reprinted from *INSIGHT* 86 *INTERNATIONAL ADVANCED FORMING/BONDING CONFERENCE*, the contents of each of which are incorporated herein by reference. On such an apparatus, fiber entanglement is accomplished by jetting liquid supplied at pressures, e.g., of at least about 100 psi to form fine, essentially columnar, liquid streams toward the surface of the supported coform. The supported coform is traversed with the streams until the fibers are entangled and intertwined. The coform can be passed through the hydraulic entangling apparatus a number of times on one or both sides. The liquid can be supplied at pressures of from about 100 to 3,000 psi. The orifices which produce the columnar liquid streams can have typical diameters known in the art, e.g., 0.005 inch, and can be arranged in one or more rows with any number of orifices, e.g., 40, in each row. Various techniques for hydraulic entangling are described in the aforementioned U.S. Pat. No. 3,485,706, and this patent can be referred to in connection with such techniques.

After the coform has been hydraulically entangled, it may, optionally, be treated at bonding station 38 to further enhance its strength. For example, a padder includes an adjustable upper rotatable top roll 40 mounted on a rotatable shaft 42, in light contact, or stopped to provide a 1 or 2 mil gap between the rolls, with a lower pick-up roll 44 mounted on a rotatable shaft 46. The lower pick-up roll 44 is partially immersed in a bath 48 of aqueous resin binder composition 50. The pick-up roll 44 picks up resin and transfers it to the hydraulically entangled coform at the nip between the two rolls 40, 44. Such a bonding station is disclosed in U.S. Pat. No. 4,612,226 to Kennette, et al., the contents of which are incorporated herein by reference. Other optional secondary bonding treatments include thermal bonding, ultrasonic bonding, adhesive bonding, etc. Such secondary bonding treatments provide added strength, but can also stiffen the coform. After the hydraulically entangled coform has passed through bonding station 38, it is dried in, e.g., through dryer 52 or a can dryer and wound on winder 54.

The coform of the present invention can also be hydraulically entangled with a reinforcing material (e.g., a reinforcing layer such as a scrim, screen, netting, knit or woven material). A particularly preferable technique is to hydraulically entangle a coform with continuous filaments of a polypropylene spunbond fabric, e.g., a spunbond web composed of fibers with an average denier of 2.3 d.p.f. A lightly point bonded spunbond can be used; however, for entangling purposes, unbonded spunbond is preferable. The spunbond can be debonded before being provided on the coform. Also, a meltblown/spunbond laminate or a meltblown/spunbond-/meltblown laminate as described in U.S. Pat. No. 4,041,203 to Brock et al can be provided on the coform web and the assembly hydraulically entangled.

Spunbond polyester webs which have been debonded by passing them through hydraulic entangling equipment can be sandwiched between, e.g., staple coform webs, and entangle bonded. Also, unbonded melt-spun polypropylene and knits can be positioned similarly between coform webs. This technique significantly increases web strength. Webs of meltblown polypropylene fibers can also be positioned between or under coform webs and then entangled. This technique improves barrier properties. Laminates of reinforcing fibers and barrier fibers can add special properties. For example, if such fibers are added as a comingled blend, other properties can be engineered. For example, lower basis weight webs (as compared to conventional loose staple webs) can be produced since meltblown fibers add needed larger numbers of fibers for the structural integrity necessary for producing low basis weight webs. Such fabrics can be engineered for control of fluid distribution, wetness control, absorbency, printability, filtration, etc., by, e.g., controlling pore size gradients (e.g., in the Z direction). The coform can also be laminated with extruded films, foams. (e.g., open cell foams), nets, staple fiber webs, etc.

It can also be advantageous to incorporate a super-absorbent material or other particulate materials, e.g., carbon, alumina, etc., in the coform. A preferable technique with respect to the inclusion of super-absorbent material is to include a material in the coform which can be chemically modified to absorb water after the hydraulic entanglement treatment such as disclosed in U.S. Pat. No. 3,563,241 to Evans et al. Other techniques for modifying the water solubility and/or absorbency are described in U.S. Patent Nos. 3,379,720 and 4,128,692 to Reid. The super-absorbent and/or particulate material can be intermingled with the non-elastic meltblown fibers and the fibrous material, e.g., the at least one of pulp fibers, staple fibers, meltblown fibers and continuous filaments at the location where the secondary gas stream of fibrous material is introduced into the primary stream of non-elastic meltblown fibers. Reference is made to U.S. Pat. No. 4,100,324 with respect to incorporating particulate material in the coform. Particulate material can also include synthetic staple pulp material, e.g., ground synthetic staple pulp fibers.

Figure 2A:
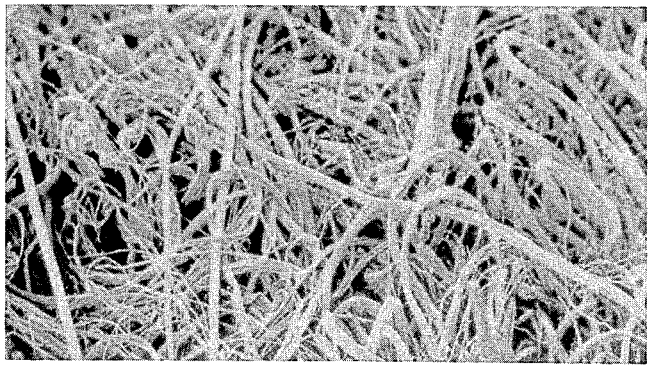
FIGS. 2A and 2B are photomicrographs (85X and 86X magnification, respectively) of respective sides of a meltblown and staple fiber coform of the present invention.
Figure 2B:
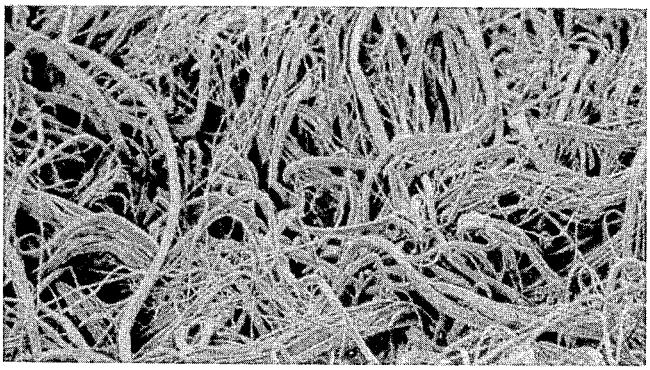

FIGS. 2A and 2B are photomicrographs of a meltblown and cotton coform of the present invention. In particular, the coform materials are 50% cotton and 50% meltblown polypropylene. The coform was hydraulically entangled at a line speed of 23 fpm on a 100×92 mesh at 200, 400, 800, 1200, 1200 and 1200 psi on each side. The coform has a basis weight of 68 gsm. The last side treated is shown facing up in FIG. 2A, while the first side treated is shown facing up in FIG. 2B.

Figure 3A:
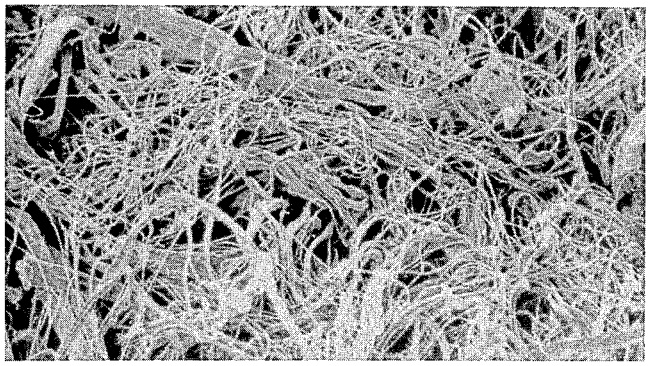
FIGS. 3A and 3B are photomicrographs (109X and 75X magnification, respectively) of respective sides of a meltblown and pulp coform of the present invention.
Figure 3B:
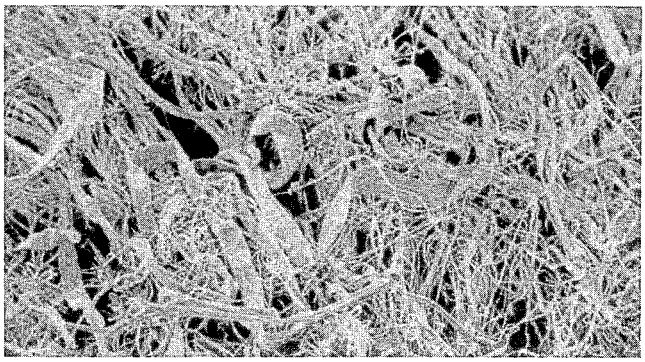

FIGS. 3A and 3B are photomicrographs of a meltblown and pulp coform of the present invention. In particular, the coform materials are 50% IPSS and 50% meltblown polypropylene. The coform was hydraulically entangled at a line speed of 23 fpm on a 100×92 mesh at 400, 400 and 400 psi on one side. The coform has a basis weight of 20 gsm. FIG. 3A shows the treated side facing up, while the untreated side is shown facing up in FIG. 3B.

Figure 4:
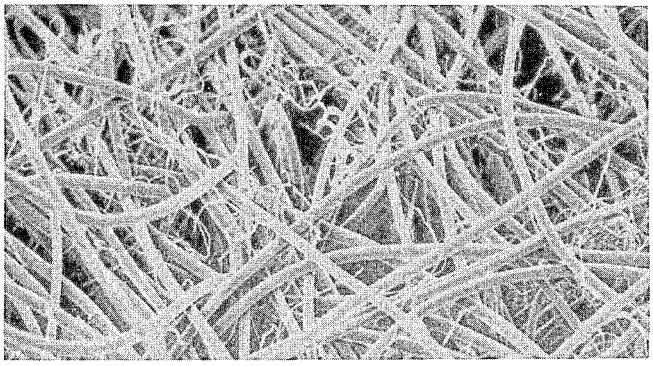
FIG. 4 is a photomicrograph (86X magnification) of a meltblown and continuous filament of spunbond coform of the present invention.

FIG. 4 is a photomicrograph of a meltblown and spunbond coform of the present invention. In particular, the coform materials are 75% spunbond polypropylene having an average diameter of about 20μ and 25% meltblown polypropylene. The coform was hydraulically entangled at a line speed of 23 fpm on a 100×92 mesh at 200 psi for six passes, 400 psi, 800 psi and at 1200 psi for three passes on one side. The coform has a basis weight of 46 gsm. The treated side is shown facing up in FIG. 4.

Various examples of processing conditions will be set forth as illustrative of the present invention. Of course, such examples are illustrative and are not limiting. For example, commercial line speeds are expected to be higher, e.g., 400 fpm or above. Based on sample work, line speeds of, e.g., 1000 or 2000 fpm may be possible.

In the following examples, the specified materials were hydraulically entangled under the specified conditions. The hydraulic entangling for the following examples was carried out using hydraulic entangling equipment similar to conventional equipment, having jets with 0.005 inch orifices, 40 orifices per inch, and with one row of orifices, as was used to form the coforms shown in FIGS. 2A, 2B, 3A, 3B and 4. The percentages of materials are given in weight percent.

EXAMPLE 1

Coform materials: IPSS - 50%/meltblown polypropylene - 50%
Hydraulic entangling processing line speed: 23 fpm
Entanglement treatment (psi of each pass); (wire mesh employed for the coform supporting member):
Side one: 750, 750, 750; 100×92
Side two: 750, 750, 750; 100×92

EXAMPLE 2

Coform materials: IPSS - 50%/meltblown polypropylene - 50%
Hydraulic entangling processing line speed: 40 fpm
Entanglement treatment (psi of each pass); (wire mesh):
Side one: 100, 750, 750, 750, 750, 750; 100×92
Side two: 750, 750, 750; 100×92

EXAMPLE 3

Coform materials: IPSS - 30%/meltblown polypropylene - 70%
Hydraulic entangling processing line speed: 40 fpm
Entanglement treatment (psi of each pass); (wire mesh):
Side One: 100, 500, 500, 500, 500, 500; 100×92
Side two: not treated

EXAMPLE 4

Coform materials: IPSS - 40%/meltblown polypropylene - 60%
Hydraulic entangling processing line speed: 40 fpm
Entanglement treatment (psi of each pass); (wire mesh):
Side one: 1200, 1200, 1200; 20×20
Side two: 1200, 1200, 1200; 20×20

EXAMPLE 5

Coform materials: IPSS - 50%/meltblown polypropylene - 50%
Hydraulic entangling processing line speed: 23 fpm
Entanglement treatment (psi of each pass); (wire mesh):
Side one: 900, 900, 900; 100×92
Side two: 300, 300, 300; 20×20

EXAMPLE 6

Coform materials: Cotton - 50%/meltblown polypropylene - 50%
Hydraulic entangling processing line speed: 23 fpm
Entanglement treatment (psi of each pass); (wire mesh):
Side one: 800, 800, 800; 100×92
Side two: 800, 800, 800; 100×92

EXAMPLE 7

Coform materials: Cotton - 50%/meltblown polypropylene - 50%
Hydraulic entangling processing line speed: 40 fpm
Entanglement treatment (psi of each pass); (wire mesh):
Side one: 1200, 1200, 1200; 20×20
Side two: 1200, 1200, 1200; 20×20

EXAMPLE 8

Coform materials: Cotton - 50%/meltblown polypropylene - 50%

Hydraulic entangling processing line speed: 40 fpm
Entanglement treatment (psi of each pass); wire mesh):
Side one: 200, 400, 800, 1500, 1500, 1500; 100×92
Side two: 200, 400, 800, 1500, 1500, 1500; 100×92

EXAMPLE 9

Coform materials: Polyethylene terephthalate staple - 50%/meltblown polybutylene terephthalate - 50%
Hydraulic entangling processing line speed: 23 fpm
Entanglement treatment (psi of each pass); (wire mesh):
Side one: 1500, 1500, 1500; 100×92
Side two: 1500, 1500, 1500; 100×92

EXAMPLE 10

Coform materials: Cotton - 60%/meltblown polypropylene - 40%
Hydraulic entangling processing line speed: 23 fpm
Entanglement treatment (psi of each pass); (wire mesh):
Side one: 1500, 1500, 1500; 100×92
Side two: 700, 700, 700; 20×20

EXAMPLE 11

A laminate having a pulp coform layer sandwiched between two staple fiber layers was subjected to hydraulic entangling as follows:
Laminate:
Layer 1: Polyethylene terephthalate - 50%/Rayon - 50% (approx. 20 gsm)
Layer 2: IPSS - 60%/meltblown polypropylene -40% (approx. 40 gsm)
Layer 3: Polyethylene terephthalate - 50%/Rayon - 50% (approx. 20 gsm)
Hydraulic entangling processing line speed: 23 fpm
Entanglement treatment (psi of each pass); (wire mesh):
Side one: 300, 800, 800; 100×92
Side two: 200, 600, 800; 20×20

EXAMPLE 12

An unbonded spunbond polypropylene (approx. 14 g/m$^2$) was sandwiched between two IPSS 50%/meltblown polypropylene - 50% (approx. 27 g/m$^2$) webs and subjected to the following hydraulic entangling procedure:
Hydraulic entangling processing line speed: 23 fpm
Entanglement treatment (psi of each pass); wire mesh):
Side one: 700, 700, 700; 100×92
Side two: 700, 700, 700; 100×92

EXAMPLE 13

A partially debonded DuPont Reemay 2006 (polyester) spunbond (approx. 20 g/m$^2$) was sandwiched between two cotton - 50%/meltblown polypropylene - 50% coform webs (approx. 15 g/m$^2$) and subjected to the following hydraulic entangling procedure:
Hydraulic entangling processing line speed: 40 fpm
Entanglement treatment (psi of each pass); (wire mesh):
Side one: 100, 1200, 1200, 1200; 100×92
Side two: 1200, 1200, 1200; 100×92

EXAMPLE 14

The same starting material as in Example 13 was subjected to the same treatment as in Example 13, except that the wire mesh was 20×20 for each side.

Physical properties of the materials of Examples 1 through 14 were measured in the following manner:

The bulk was measured using an Ames bulk or thickness tester (or equivalent) available in the art. The bulk was measured to the nearest 0.001 inch.

The basis weight and MD and CD grab tensiles were measured in accordance with Federal Test Method Standard No. 191A (Methods 5041 and 5100, respectively).

The abrasion resistance was measured by the rotary platform, double-head (Tabor) method in accordance with Federal Test Method Standard No. 191A (Method 5306). Two type CS10 wheels (rubber based and of medium coarseness) were used and loaded with 500 grams. This test measured the number of cycles required to wear a hole in each material. The specimen is subjected to rotary rubbing action under controlled conditions of pressure and abrasive action.

A "cup crush" test was conducted to determine the softness, i.e., hand and drape, of each of the samples. This test measures the amount of energy required to push, with a foot or plunger, the fabric which has been pre-seated over a cylinder or "cup." The lower the peak load of a sample in this test, the softer, or more flexible, the sample. Values below 100 to 150 grams correspond to what is considered a "soft" material.

The absorbency rate of the samples was measured on the basis of the number of seconds to completely wet each sample in a constant temperature water bath and oil bath.

The results of these tests are shown in Table 1. In Table 1, for comparative purposes, are set forth physical properties of two known hydraulically entangled nonwoven fibrous materials, Sontara ®8005, made with a 100% polyester staple fiber (1.35 d.p.f.×¾") from E. I. DuPont de Nemours and Company, and Optima ®, a woodpulp-polyester fabric converted product from American Hospital Supply Corp. Table 2 shows, for comparative purposes, physical properties of the coform material of Examples 1, 6, 9 and 12 before the coform material is subjected to hydraulic entangling treatment. The unentangled coform material of Examples 1, 6, 9 and 12 has been designated 1', 6', 9' and 12', respectively, in Table 2.

TABLE 1

| | | | MD Grab Tensiles | | | | |
|---|---|---|---|---|---|---|---|
| Example | Basis Wt. (gsm) | Bulk (in) | Peak Energy (in-lb) | Peak Load (lb) | Peak Elongation (in) | Peak Strain (%) | Fail Energy (in-lb) |
| 1 | 65 | 0.025 | 5.2 | 5.9 | 1.6 | 53.9 | 7.4 |
| 2 | 69 | 0.023 | 2.0 | 6.8 | 0.5 | 16.5 | 3.4 |
| 3 | 39 | 0.013 | 0.6 | 3.1 | 0.3 | 11.0 | 1.3 |
| 4 | 93 | 0.034 | 2.3 | 7.6 | 0.5 | 17.3 | 4.1 |
| 5 | 65 | 0.028 | 1.1 | 3.1 | 0.6 | 20.2 | 2.3 |
| 6 | 59 | 0.026 | 6.3 | 9.1 | 1.6 | 51.9 | 16.4 |
| 7 | 40 | 0.025 | 4.2 | 5.7 | 1.3 | 42.7 | 10.1 |
| 8 | 94 | 0.028 | 8.9 | 12.3 | 1.3 | 41.7 | 18.0 |
| 9 | 68 | 0.034 | 13.4 | 22.9 | 1.8 | 58.9 | 44.9 |

TABLE 1-continued

| | | | | | | | |
|---|---|---|---|---|---|---|---|
| 10 | 63 | 0.031 | 14.3 | 14.5 | 1.6 | 60.8 | 28.8 |
| 11 | 92 | 0.034 | 1.5 | 5.6 | 0.5 | 15.3 | 4.7 |
| 12 | 72 | 0.029 | 32.2 | 26.1 | 2.6 | 86.9 | 57.4 |
| 13 | 40 | 0.022 | 12.1 | 21.9 | 1.2 | 39.3 | 30.1 |
| 14 | 49 | 0.026 | 13.0 | 17.1 | 1.3 | 42.8 | 26.8 |
| Sontara ® 8005 | 65 | 0.020 | 20.1 | 42.3 | 1.0 | 34.6 | 40.4 |
| Optima ® | 72 | 0.020 | 12.9 | 26.3 | 1.0 | 33.8 | 35.1 |

| | CD Grab Tensiles | | | | | Tabor Abrasion Resistance (no. of cycles) | | Absorbency* | | Cup Crush (softness) | |
|---|---|---|---|---|---|---|---|---|---|---|---|
| Example | Peak Energy (in-lb) | Peak Load (lb) | Peak Elongation (in) | Peak Strain (%) | Fail Energy (in-lb) | Side 1 | Side 2 | Water Sink (sec) | Oil Sink (sec) | Peak Load (grams) | Total Energy (grams/mm) |
| 1 | 4.0 | 4.2 | 1.8 | 61.4 | 6.2 | 12 | 7 | 1.1 | 1.1 | 111 | 2056 |
| 2 | 1.7 | 3.4 | 0.9 | 28.9 | 2.1 | 16 | 14 | 1.6 | 0.9 | 292/125** | 5419/2026** |
| 3 | 1.4 | 2.3 | 1.1 | 36.5 | 2.0 | 8 | 5 | 1.4 | 0.9 | 89 | 1339 |
| 4 | 3.4 | 5.0 | 1.3 | 41.7 | 4.1 | 11 | 10 | 1.1 | 1.3 | — | — |
| 5 | 1.2 | 2.6 | 1.0 | 31.2 | 2.2 | 7 | 5 | 1.2 | 0.9 | 160 | 2912 |
| 6 | 7.1 | 7.1 | 1.9 | 64.7 | 14.8 | 23 | 19 | 0.4 | — | 120 | 2097 |
| 7 | 4.2 | 3.8 | 2.3 | 76.9 | 7.1 | 12 | 9 | | | 86 | 1357 |
| 8 | 14.0 | 15.5 | 1.7 | 56.2 | 25.2 | 55 | 49 | | | — | — |
| 9 | 17.3 | 23.5 | 2.6 | 86.5 | 41.6 | 100+ | 51 | | | 115 | 2126 |
| 10 | 7.1 | 7.2 | 2.1 | 69.5 | 15.9 | 37 | 33 | | | 148 | 2599 |
| 11 | 2.0 | 2.8 | 1.2 | 38.5 | 3.4 | 25 | 14 | <0.1 | 0.6 | — | — |
| 12 | 27.1 | 12.8 | 3.5 | 116.2 | 52.0 | 100+ | 100+ | | | 190 | 3846 |
| 13 | 9.1 | 11.2 | 1.4 | 46.5 | 16.0 | — | — | | | 245 | 4912 |
| 14 | 10.8 | 11.8 | 1.6 | 53.8 | 19.7 | 84 | 54 | | | 194 | 3859 |
| Sontara ® 8005 | 23.0 | 18.5 | 4.0 | 134.3 | 39.8 | 28 | 20 | | | 89 | 1537 |
| Optima ® | 16.6 | 22.1 | 2.1 | 71.0 | 32.0 | 93 | 24 | | | 196 | 3522 |

*Surfactant treated with Rohm and Haas Triton X-102
**Mechanically treated (softened in dryer)

TABLE 2

| Unen-tangled Coform of Example | Basis Wt. (gms) | Bulk (in) | MD Grab Tensiles | | | | | CD Grab Tensiles | | | | |
|---|---|---|---|---|---|---|---|---|---|---|---|---|
| | | | Peak Energy (in-lb) | Peak Load (lb) | Peak Elongation (in) | Peak Strain (%) | Fail Energy (in-lb) | Peak Energy (in-lb) | Peak Load (lb) | Peak Elongation (in) | Peak Strain (%) | Fail Energy (in-lb) |
| 1 | 63 | 0.041 | 0.6 | 2.0 | 0.5 | 16.7 | 2.2 | 4.1 | 4.2 | 1.6 | 54.7 | 6.5 |
| 2 | 53 | 0.048 | 1.9 | 2.7 | 1.1 | 35.8 | 4.0 | 4.2 | 3.8 | 1.9 | 63.1 | 7.6 |
| 3 | 67 | 0.078 | 0.4 | 0.5 | 1.4 | 46.4 | 1.7 | 7.6 | 2.3 | 5.2 | 172.6 | 16.8 |
| 4 | 72 | 0.059 | 1.2 | 2.6 | 0.8 | 26.1 | 3.0 | 1.8 | 2.3 | 1.3 | 44.4 | 3.4 |

As can be seen in the foregoing Table 1, nonwoven fibrous material within the scope of the present invention can have an excellent combination of properties of strength and abrasion resistance. Moreover, it is possible to obtain materials having a range of abrasion resistance and softness using the same substrate by varying the process conditions, e.g., mechanically softening. The use of meltblown fibers in the present invention provides webs having greater CD recovery.

The webs of the present invention have unoriented fibers, unlike carded webs, and thus have good isotropic strength properties. Moreover, the webs of the present invention have higher abrasion resistance than comparable carded webs. The process of the present invention is more advantageous than embossing since embossing creates interfiber adhesion in a web, resulting in a stiffer web. Laminates including the coform of the present invention have increased strength and can be used as, e.g., garments.

This case is one of a group of cases which are being filed on the same date. The group includes (1) "Nonwoven Fibrous Hydraulically Entangled Elastic Coform Material And Method Of Formation Thereof," F. Radwanski et al (application Ser. No. 07/170,196); (2) "Nonwoven Fibrous Hydraulically Entangled Non-Elastic Coform Material And Method Of Formation Thereof," F. Radwanski et al (application Ser. No. 07/170,208); (3) "Hydraulically Entangled Nonwoven Elastomeric Web And Method Of Forming The Same," F. Radwanski et al (application Ser. No. 07/170,209); (4) "Nonwoven Hydraulically Entangled Non-Elastic Web And Method Of Formation Thereof," F. Radwanski et al (application Ser. No. 07/170,200); and (5) "Nonwoven Material Subjected To Hydraulic Jet Treatment in Spots, And Method And Apparatus For Producing The Same," F. Radwanski (application Ser. No. 07/170,193). The contents of the other applications in this group, other than the present application, are incorporated herein by reference.

While we have shown and described several embodiments in accordance with the present invention, it is understood that the same is not limited thereto, but is susceptible of numerous changes and modifications as are known to one having ordinary skill in the art, and we therefor do not wish to be limited to the details shown and described herein, but intend to cover all such modifications as are encompassed by the scope of the appended claims.

What is claimed is:

1. A nonwoven fibrous non-elastic web comprising a substantially homogeneous admixture of non-elastic meltblown fibers and at least one type of secondary fibers wherein said non-elastic meltblown fibers are hydraulically entangled with said secondary fibers.

2. The nonwoven fibrous non-elastic web according to claim 1, wherein said secondary fibers are selected from the group including pulp fibers, staple fibers, meltblown fibers and continuous filaments.

3. The nonwoven fibrous non-elastic web according to claim 1, wherein said admixture comprises a coform web of non-elastic meltblown fibers and at least one type of secondary fibers selected from the group including pulp fibers, staple fibers, meltblown fibers and continuous filaments.

4. The nonwoven fibrous non-elastic web according to claim 2, wherein said admixture consists essentially of non-elastic meltblown fibers and pulp fibers.

5. The nonwoven fibrous non-elastic web according to claim 2, wherein said non-elastic meltblown fibers are made from a thermoformable material selected from the group, including polypropylene, polyethylene, polybutylene terephthalate and polyethylene terephthalate.

6. The nonwoven fibrous non-elastic web according to claim 2, wherein said admixture consists essentially of non-elastic meltblown fibers and staple fibers.

7. The nonwoven fibrous non-elastic web according to claim 6, wherein said staple fibers are natural staple fibers.

8. The nonwoven fibrous non-elastic web according to claim 6, wherein said staple fibers are synthetic staple fibers.

9. The nonwoven fibrous non-elastic web according to claim 2, wherein said admixtures consists essentially of non-elastic meltblown fibers.

10. The nonwoven fibrous non-elastic web according to claim 9, wherein said admixture consists essentially of non-elastic meltblown microfibers and non-elastic meltblown macrofibers.

11. The nonwoven fibrous non-elastic web according to claim 1, wherein said material has at least one patterned surface.

12. The nonwoven fibrous non-elastic web according to claim 1, wherein said admixture further comprises a particulate material.

13. The nonwoven fibrous non-elastic web according to claim 12, wherein said particulate material is a superabsorbent material.

14. The nonwoven fibrous non-elastic web according to claim 2, wherein said admixture consists essentially of non-elastic meltblown fibers and continuous filaments.

15. The nonwoven fibrous non-elastic web according to claim 14, wherein said continuous filaments are spunbound continuous filaments.

16. A nonwoven fibrous reinforced non-elastic web comprising:

a substantially homogeneous coform web of:

non-elastic meltblown fibers, and at least one type of secondary fibers, and a reinforcing material, wherein said non-elastic meltblown fibers, said secondary fibers and said reinforcing material are joined by hydraulic entangling.

17. The nonwoven fibrous reinforced non-elastic web according to claim 16, wherein said coform web includes fibers selected from pulp fibers, staple fibers, meltblown fibers and continuous filaments.

18. The nonwoven fibrous reinforced non-elastic web according to claim 16, wherein said reinforcing material is a spunbond material.

19. A process for forming a nonwoven non-elastic web comprising:

providing a substantially homogeneous admixture comprising:

non-elastic meltblown fibers, and at least one type of secondary fibers; and directing a plurality of high-pressure liquid streams toward a surface of said admixture said non-elastic meltblown fibers and said secondary fibers.

20. The process according to claim 19 wherein said material has at least one patterned surface.

21. The process according to claim 19, wherein said plurality of high-pressure liquid streams are directed to said surface of said admixture a plurality of times.

22. The process according to claim 19, wherein said plurality of high-pressure liquid streams are directed toward each surface of said admixture.

23. A process for forming a nonwoven fibrous reinforced non-elastic web comprising:

providing a composite comprising:

a substantially homogeneous admixture of non-elastic meltblown fibers and at least one type of secondary fibers, and a reinforcing material; and directing a plurality of high-pressure liquid streams toward at least one surface of said composite to entangle said non-elastic meltblown fibers with said secondary fibers and said reinforcing material.

24. The process according to claim 23 wherein said plurality of high-pressure liquid streams are directed toward each surface of said composite.

25. The product formed by the process of claim 19.

26. The product formed by the process of claim 23.

* * * * *

UNITED STATES PATENT AND TRADEMARK OFFICE

CERTIFICATE OF CORRECTION

PATENT NO. : 4,931,355

DATED : June 5, 1990

INVENTOR(S) : Radwanski et al

It is certified that error appears in the above-identified patent and that said Letters Patent is hereby corrected as shown below:

Column 2, line 14, "psi)" should read --(psi) --

Column 15, lines 43 and 44, "spunbound" should read --spunbond--.

Column 16, line 22, "admixture said" should read --admixture to entangle said --.

Signed and Sealed this

Eleventh Day of May, 1993

*Attest:*

Michael K. Kirk

MICHAEL K. KIRK

*Attesting Officer*

*Acting Commissioner of Patents and Trademarks*